US005662005A

United States Patent [19]

Garman

[11] Patent Number: 5,662,005

[45] Date of Patent: Sep. 2, 1997

[54] RESTRAINT MECHANISM FOR A CONTROL LEVER

[75] Inventor: Ronald H. Garman, Pekin, Ill.

[73] Assignee: Caterpillar Inc., Peoria, Ill.

[21] Appl. No.: 548,627

[22] Filed: Oct. 26, 1995

[51] Int. Cl.[6] ..... G05G 1/04

[52] U.S. Cl. ..... 74/526; 74/473 R

[58] Field of Search ..... 74/473 R, 526, 74/491; 192/4 R, 4 C

[56] References Cited

U.S. PATENT DOCUMENTS

| | | | |
|---|---|---|---|
| 4,282,769 | 8/1981 | Sandrock | 74/526 X |
| 4,291,589 | 9/1981 | Highland | 74/526 |
| 4,548,094 | 10/1985 | Huitema et al. | 74/526 |
| 4,552,031 | 11/1985 | Barbagli | 74/526 X |
| 4,704,915 | 11/1987 | Friesen et al. | 74/526 X |
| 5,152,268 | 10/1992 | Hendron et al. | 74/526 X |
| 5,499,553 | 3/1996 | Schott et al. | 74/526 |
| 5,542,891 | 8/1996 | Kettle, Jr. et al. | 74/526 X |

*Primary Examiner*—Charles A. Marmor
*Assistant Examiner*—Saúl J. Rodríquez
*Attorney, Agent, or Firm*—William C. Perry

[57] ABSTRACT

In construction machines it quite common to utilize a plurality of control levers to manipulate a multitude of implements. It has often been a problem to quickly and accurately establish a connection between the control lever and the implement since the control lever is often quite some distance away from the mechanism that controls the implement. In many instances multiple personnel are required to properly assemble the various components. This leads to added expense and complexity of the assembly process. The present invention includes a restraint mechanism for a control lever that positively holds the control lever at a preselected location with respect to an established operational pattern. With the control lever locked in the preselected location, the connection of the control lever with the remaining components may be done in an extremely efficient and cost effective manner

10 Claims, 2 Drawing Sheets

RESTRAINT MECHANISM FOR A CONTROL LEVER

TECHNICAL FIELD

This relates generally to control levers and more particularly to a mechanism used to restrain the control lever from movement.

BACKGROUND ART

In construction machines it is very common to have multiple levers at an operators disposal to control the movement of the machine as well as the implements that are attached to the machine. These levers are commonly positioned within an operator station mounted on the machine and are connected by various linkage arrangements to control valves that in turn control the various implements and machine functions. It is very important that these levers are adjusted properly with respect to the connecting linkage to insure efficient operation of the machine. In many instances, the adjustment of these linkages occurs at a location that is remote from that of the control levers. It is important therefore to have a positive mechanism to hold the control lever in a preselected position, usually the neutral position, so that proper adjustment may be made to the connecting linkage. In many instances one individual is required to maintain the position of the control lever in the neutral position while a second adjusts the connecting linkage. Aside from being an inefficient use of personnel, it also lends itself to an inaccurate adjustment in the event two people are not available when it is necessary to make the proper adjustments.

The present invention is directed to overcoming one or more of the problems as set forth above.

DISCLOSURE OF THE INVENTION

In one aspect of the invention a restraint mechanism for a control lever is disclosed. The restraint mechanism includes a base plate that defines a preselected path of movement for the control lever that includes a preselected location for a neutral position of the control lever. A bail member having a recess defined therein is mounted to the base plate for pivotal movement with respect thereto between a first position wherein the recess is in contact with the control lever to maintain the control lever in its neutral position and a second position wherein the recess is moved away from contact with the control lever to permit movement of the control lever. A means for locking the bail in one of its first or second positions is also included.

With a control mechanism as set forth above, the control lever for an implement for a machine may be positively held in place in a preselected position, such as a neutral position, while the connecting links between the control lever and the implement are connected or adjusted. In doing so, the service and adjusting procedure is greatly simplified and the manpower required to perform the procedure is greatly reduced.

BEST MODE FOR CARRYING OUT THE INVENTION

Figure 1:
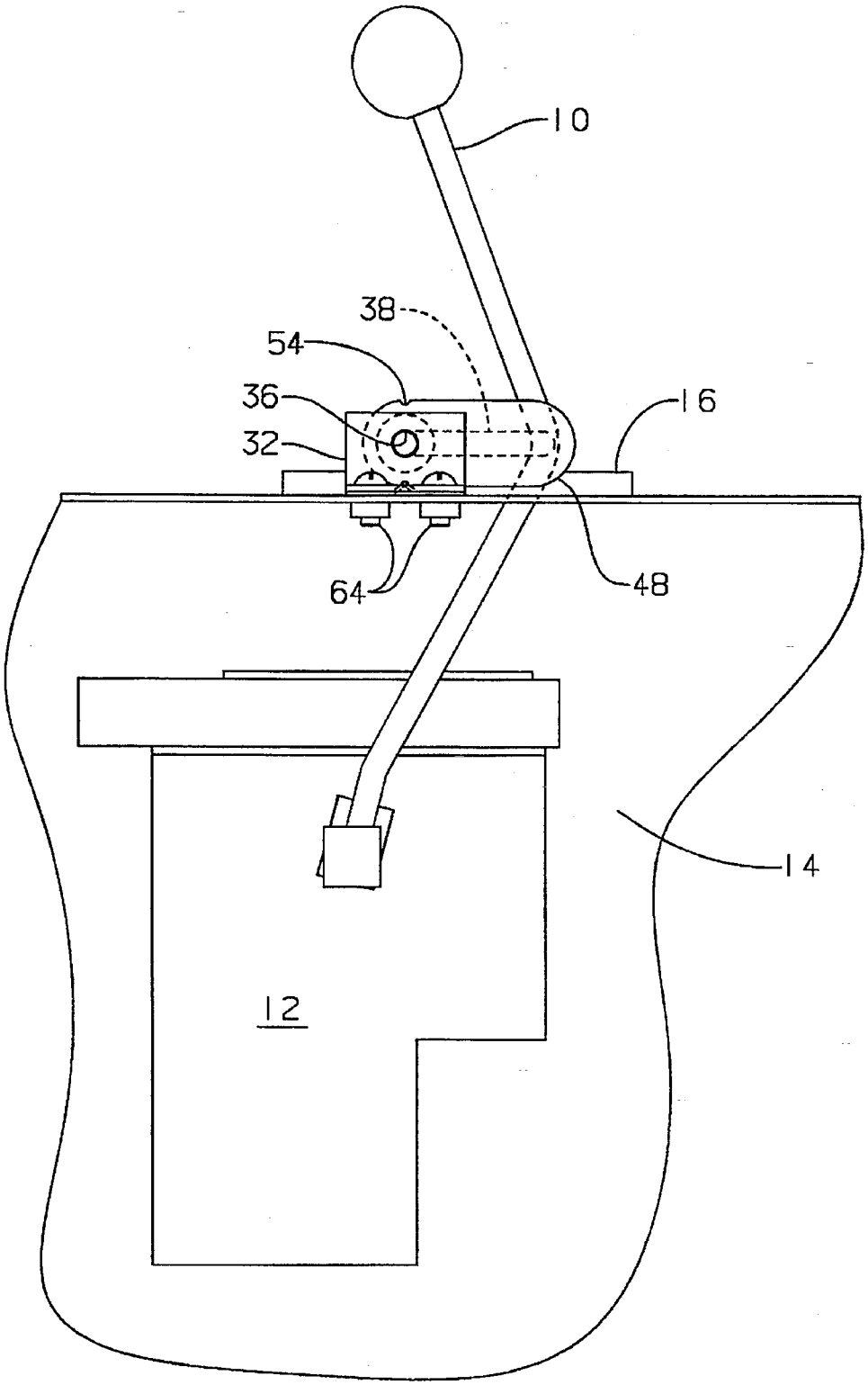
FIG. 1 is a diagrammatic end view of a control lever that embodies the principles of the present invention.

Referring now to the drawings, it can be seen that a control lever 10 is positioned to extend upwardly from a control module 12. The control module is positioned within a housing 14 in the cab of a construction machine or the like and controls the operation of an implement such as a winch, for example. The housing 14, which is only partially shown in the drawings, encases the control module and mounts a plate 16 on an upper portion thereof that defines an opening 17 that will be described in greater detail hereinafter.

Figure 2:
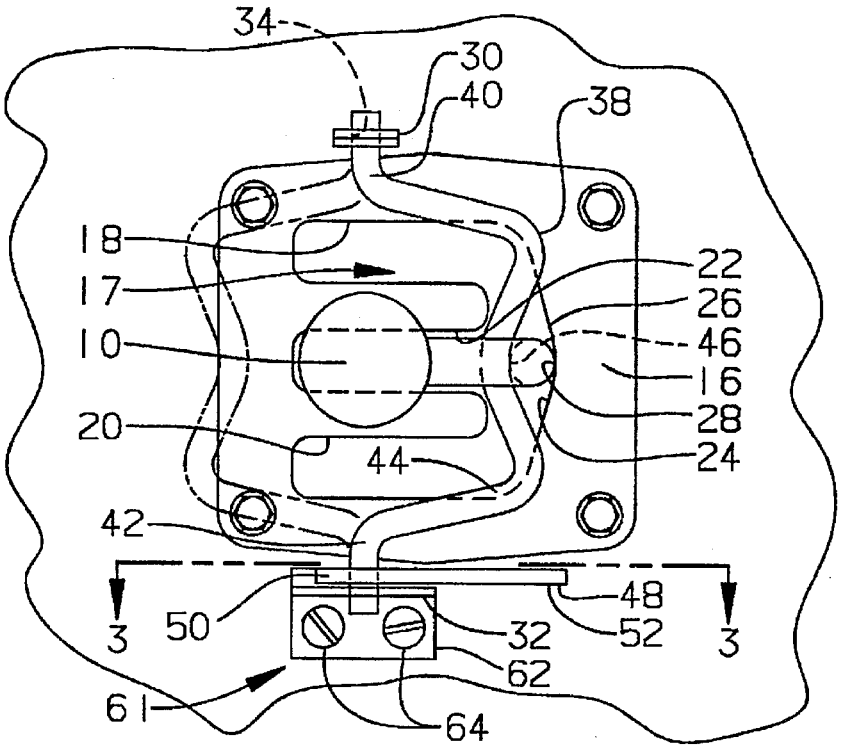
FIG. 2 is a diagrammatic top view of the control lever shown in FIG. 1.

Referring to FIG. 2 it can be seen that the control lever 10 extends through the opening 17 in plate 16 to a location within the cab that is optimally within easy operating distance of an operator when he is in position to operate the machine. The opening 17 is defined by a series of connected channels or slots that are formed in the plate 16 to provide a preselected pattern of movement for the control lever. The slots are formed generally in an "M" configuration with respect to the operator and the control lever is of sufficient size to move freely along and between each of the slots. Movement in a first leg of the "M", or slot 18 as viewed in the drawings, corresponds to a specific implement function while movement in a second leg of the "M", or slot 20, will result in a different implement function. Movement in a third slot 22, positioned between the first and second slots, actuates a third implement function. A fourth slot 24, extends along an upper extremity of the slots and interconnects all of them. The fourth slot acts as a neutral slot when the control lever is moving from one slot to the next. One of the edges 26 of the fourth slot is angled and forms a slight recess 28 that is substantially centrally positioned along the edge 26 and is positioned for alignment with the third slot 22.

A pair of bracket members 30 and 32 are secured to the housing 14 on opposing sides of the slots formed in the plate 16. Bracket 30 is mounted adjacent the first slot 18 and extends upwardly a distance sufficient to define a centrally disposed bore 34. The second bracket member 32 is positioned adjacent the second slot 20 and, like the first bracket, extends upwardly from housing 14 and defines a bore 36 (FIG. 1) that is substantially centrally disposed therethrough.

A bail member 38 is positioned in overlying relationship to the slot pattern. The bail member is formed from a rod or similar cylindrical stock and defines a first leg portion 40 that has a diameter that may be received within the bore 34 of the first bracket member 30. Likewise, the bail member 38 defines a second leg portion 42 that is received in the bore 36 of the second bracket 32. A third portion 44 of the bail member extends between the first and second portions, connecting them together. The third portion 44 is angled to form a recess 46 that is substantially centrally positioned along the third portion. The angled portion 44 gives the bail member an overall configuration similar to that of an inverted "W" as positioned in relation to the operator. The location of the recess 46 is such that it is in alignment in opposing fashion with the recess 28 defined in the fourth slot 24. The opposing recesses 46 and 28 are spaced from one another a distance that is just large enough to receive the diameter of the control handle. In this position, the control lever is captured in a preselected neutral position, which in the illustrated implement, is a position that corresponds to a "brake on" condition for a winch. The bail member may be rotated to a second position away from contact with the control lever to allow the control lever freedom to move within and between any of the slots.

A handle member 48 has a first end portion 50 that is secured to the first leg portion of the bail member 38. A second end portion 52 extends outwardly from the first portion 50 and defines a grasp for the handle member. The first portion 50 has a rounded surface 51 that terminates at a pair of detents 54 and 55 respectively that are positioned approximately 180 degrees apart. The first detent 54 joins the rounded surface 51 at a juncture that forms a small cam lobe 56. In a similar fashion, a second cam lobe 58 is defined at the juncture between the second detent 55 and the rounded surface 51.

A locking means, generally shown at 60, is shown as a spring member 61 of the type that is formed from sheet metal, spring steel or the like. The spring member includes a base member 62 that is adapted to be mounted to the housing 14 by a pair of bolts 64. A leg portion 66 is sprung from the base member 62 and extends upwardly from the base member. The base member is mounted adjacent the handle member 48 so that the leg portion 66 is biased against the first portion 50 of the handle 48. The leg portion 66 defines a projection 68 that has a configuration that will allow it to nest within the detents 52 and 54. When engaged with either of the respective detents, the leg portion will maintain the handle member 50 in either of its first or second positions.

Industrial Applicability

In operation, the control lever 10 is shown to control multiple implement functions, through its movement within the preselected slot pattern, such as a winch assembly for example. In the disclosed embodiment, the control lever is operable in the first slot and second slots 18 and 20 to control the direction of rotation of the winch assembly. When operating in the third slot 22, the various brake functions for the winch assembly are controlled. When the control lever is operating in the fourth slot 24, the brake is maintained in the "on" position while the control lever is moved from one winch function to the other thus maintaining the winch in substantially a neutral condition. During this movement, the bail member 38 is maintained in its second position as is shown in phantom lines in FIG. 2. In this position, the handle member 48, and thus the bail member 38, is rotated to the right from the position shown in FIG. 3. In this position, the second detent 55 is engaged with the projection 68 defined on the leg portion 66 of the spring means 60, allowing the control lever to move unimpeded within the control pattern.

Figure 3:
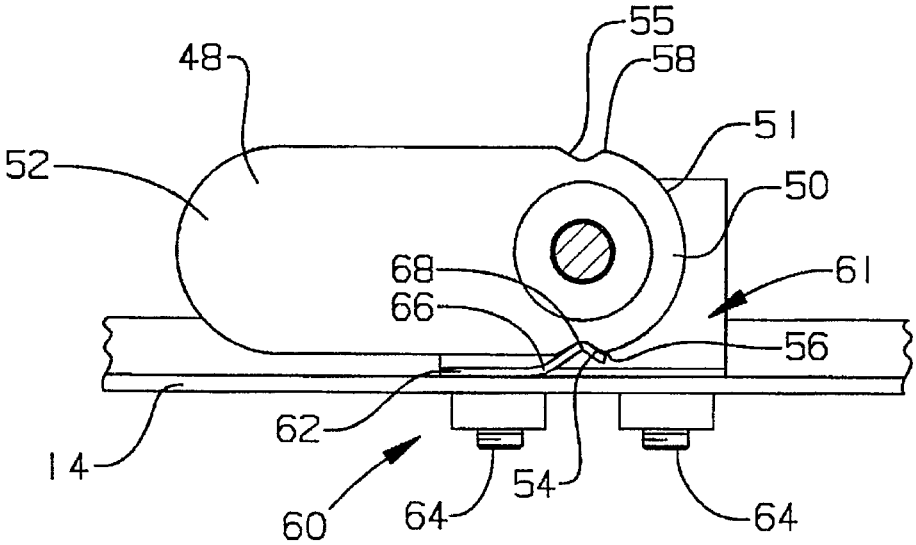
FIG. 3 is a diagrammatic section view taken along lines 3—3 of FIG. 2.

When it is desirable to maintain the control lever 12 in a preselected neutral position, such as during assembly or after service, the handle member 48 may be rotated to the left as viewed in FIG. 3 to move the bail member 38 toward the control lever. When this motion is initiated, the cam lobe 58 will engage the leg portion 66 of the spring member and move the projection out of engagement with the detent 54 as rotation of the handle member occurs to permit movement of the bail member. The handle and bail members are permitted to rotate approximately 180 degrees until the first detent falls into engagement with the projection 68 of the leg portion 66. When in this position, the recess 46 of the bail member is aligned with the recess 28 defined by the fourth slot 24. The angled third portion 44 of the bail member will move the control lever into a position between the aligned recesses 28 and 46 where it is captured and further movement within the control slots is prevented.

It is to be understood that while this restraint mechanism is shown in conjunction with the operation of a winch assembly, it is well within the scope of the subject invention to be applicable to other implement controls as well. It is apparent that this restraint mechanism may be used to fix the position of a control lever in a preselected location. In doing so, the connections between the control module and the control lever may be established with the control lever in a known position. In doing so, the connections may be established by a single individual whether during initial installation or after the performance of some type of service procedure. This results in an extremely efficient and cost effective design.

Other aspects, objects and advantages of this invention can be obtained from a study of the drawings, the disclosure and the appended claims.

I claim:

1. A restraint mechanism for a control lever, comprising:

a base plate defining a preselected path of movement for the control lever, said pattern of movement defining a preselected location for a neutral position of the control lever;

a bail member having a recess defined therein and being mounted to the base plate for pivotal movement with respect thereto between a first position wherein the recess is in contact with the control lever to maintain said control lever in its neutral position, and a second position wherein the recess is moved away from contact with the control lever to permit movement of the control lever;

means for locking the bail member in one of said first and second positions, said locking means having a first and second detent defined on opposing sides thereof;

a spring member having a base member formed from sheet metal and a leg portion that extends upwardly from the base member, said leg portion further defining a projection thereon that is adapted to engage the first and second detents.

2. The restraint mechanism as set forth in claim 1 wherein the control lever controls an implement on a construction machine.

3. The restraint mechanism as set forth in claim 2 wherein the preselected pattern of movement of the control lever is shaped substantially in an "M" configuration having a first slot of movement corresponding to a first implement function, a second slot of movement corresponding to a second implement function, and a third slot of movement positioned between the first and second slots that corresponds to a third implement function.

4. The restraint mechanism as set forth in claim 3 wherein the implement is a winch assembly and the movement of the control lever in the first slot controls the direction of rotation of the winch in a first direction and the movement of the control lever in the second slot controls the rotation of the winch in a direction opposite that of the first slot, and movement of the control lever in the third slot controls the brake function of the winch assembly.

5. The restraint mechanism as set forth in claim 4 wherein the neutral position of the control lever is positioned for alignment with the third slot.

6. The restraint mechanism as set forth in claim 1 wherein the bail member is shaped generally in an inverted "W" configuration and has a first portion adapted for receipt within an aperture defined by a first bracket member secured to the base plate on a first side of the preselected path of movement and a second portion adapted for receipt within an aperture defined by a second bracket member secured to the base plate on a side of the preselected path of movement opposite that of said first bracket and a third portion connecting the first and second portions, said third portion having an angled portion formed therein to define the recess.

7. The restraint mechanism as set forth in claim 1 wherein the locking means includes a handle member fixedly attached to the bail member to rotate the bail member between its first and second positions.

8. The restraint mechanism as set forth in claim 7 wherein the handle member defines a first portion connected to the bail member and a second engaging portion that extends away from the bail member.

9. The restraint mechanism as set forth in claim 1, wherein the spring member is mounted to the base plate immediately subjacent the handle member, wherein engagement of the first detent with the spring member holds the bail member in its first position and engagement of the second detent with the spring member.

10. The restraint mechanism as set forth in claim 9 wherein a cam surface is defined on the first portion of the handle member, said cam surface extending between the first and second detents and defining a pair of lobes that are adapted to engage the spring member upon initiation of movement of the handle member between its first and second positions, to move the spring member out of engagement with the respective detent to permit rotation of the handle member and the bail member.

* * * * *